United States Patent [19]

Yates et al.

[11] Patent Number: 4,644,938

[45] Date of Patent: Feb. 24, 1987

[54] HAND EXERCISER

[75] Inventors: Jan B. Yates, Reynoldsburg; Lawrence M. Lubbers, Worthington, both of Ohio

[73] Assignee: Danninger Medical Technology, Columbus, Ohio

[21] Appl. No.: 693,672

[22] Filed: Jan. 22, 1985

[51] Int. Cl.[4] ..... A61H 1/02

[52] U.S. Cl. ..... 128/26; 128/77; 128/25 R

[58] Field of Search ..... 128/26, 25 B, 25 R, 128/77; 272/67, 68; 254/276; 84/465

[56] References Cited

U.S. PATENT DOCUMENTS

| | | | |
|---|---|---|---|
| 696,221 | 3/1902 | Anderson | 254/276 X |
| 3,347,547 | 10/1967 | Hynes | 272/67 |
| 3,756,222 | 9/1973 | Ketchum | 128/26 |
| 3,780,989 | 12/1973 | Peterson | 254/276 X |
| 4,220,334 | 9/1980 | Kanamoto et al. | 272/67 |
| 4,368,728 | 1/1983 | Pasbrig | 128/26 |
| 4,487,199 | 12/1984 | Saringer | 128/25 R |

*Primary Examiner*—Richard J. Apley
*Assistant Examiner*—John L. Welsh
*Attorney, Agent, or Firm*—Pearne, Gordon, McCoy & Granger

[57] ABSTRACT

A device for exercising an articulated limb such as a finger includes an elastomeric element for biasing the finger to a flexed position and a motorcontrolled cable is provided to oppose the flexion bias. The elastomeric element, motor, and cable are carried on the arm by a splint. A feed mechanism is provided for regulating the length of cable, which in turn regulates the degree of flexion and extension. The feed mechanism includes a motor having an automatic mode which continuously reverses motor operation when programmed flexion and extension limits are reached. An overtravel is provided to maintain a constant tension on the cable should a sudden extension of the finger prevent proper cable feed or take-up.

11 Claims, 6 Drawing Figures

HAND EXERCISER

BACKGROUND OF THE INVENTION

1. Technical Field

The invention relates generally to orthopedic devices used in physical therapy and rehabilitation. More specifically, the invention relates to apparatus for effectuating passive movement of fingers on a human hand.

2. Description of the Related Art

A known rehabilitation type technique for joints following joint surgery is continuous passive motion ("CPM"). The use of CPM is also being examined for degenerative joint diseases, such as arthritis. Devices have been designed to impart passive motion to the joints of the leg and, in particular, with a focus on the knee joint.

It is a relatively new concept to apply CPM to the hand to cause articulatory movement of the fingers. Since the fingers involve a number of joints which all describe a differing path of motion, it is difficult to design a machine which causes controlled passive articulatory movement of the fingers about all three joints. In addition to movement of the joints, it is necessary to obtain movement of the ligaments, tendons, and other associated gliding soft tissues to keep them from adhering to bones and surrounding soft tissues. It is also difficult to design a machine which can be applied to all fingers of the hand, including the thumb, and can be applied to more than one finger at a time, and which is easily adjustable for use with hands of differing sizes.

In known CPM hand devices, finger movement is caused by a motor-driven rigid or semirigid cable attached to a fingertip. The motor is attached at the bottom of the wrist and the finger is moved in flexion and extension as the semirigid cable pushes and pulls the finger. Other devices produce a multiple change in the angle of a linear arm attached to a fingertip to forcefully flex and extend the digits. Finally, the hand may be strapped in the middle of an apparatus that has a series of tracks or a rotating arm linked to the tips of the fingers to cause flexion and extension motion.

These known devices either bend the fingers through the angulatory arch of the digits or forcefully manipulate the fingers first in one direction (e.g., flexion) and then in the other (e.g., extension) to cause direct motor-driven flexion and extension.

SUMMARY OF THE INVENTION

The present invention provides a new and improved apparatus for effectuating passive and active articulatory movement of human fingers, including radial and angulatory motion about all three joints, in a controllable manner. The device allows individual motion of each finger, but can be applied to more than one finger at a time. It can also be used for the thumb.

According to one aspect of the invention a portable apparatus is shown which utilizes an elastic element to flex the fingers and provides a flexible cable under relatively constant tension opposing the elastic element, thereby causing extension of the fingers. The cable is maintained under tension by a control motor and cable feed mechanism. The use of the elastic element provides a biasing force which is constant and which is mechanically easy to produce, such as by a rubber band or spring. The motor opposes this biasing force to cause controlled movement between a first and second position.

According to another aspect of the invention a drive mechanism for a flexible cable is shown which provides an overtravel feature to prevent excessive cable feed when an obstruction prevents motor-controlled movement of the fingers and which permits faster cable retraction than the control motor would otherwise allow. The drive mechanism also provides mechanical stop features to prevent excessive extension or flexion of the fingers.

Still another aspect of the invention is a pulley mechanism which minimizes friction on the control cable, thereby reducing cable wear and minimizing the torque requirements of the drive motor.

According to yet another aspect of the invention, an apparatus is shown which is lightweight and fully adjustable to different arm sizes and lengths and which utilizes a low torque motor, thereby minimizing electrical power requirements. The apparatus can be programmed to operate in a manual or automatic mode over a variable range of flexion and extension angles and distances.

These and other aspects of the present invention will be more fully described and understood in the following specification in view of the accompanying drawings.

DETAILED DESCRIPTION OF THE PREFERRED EMBODIMENT

Figure 1:
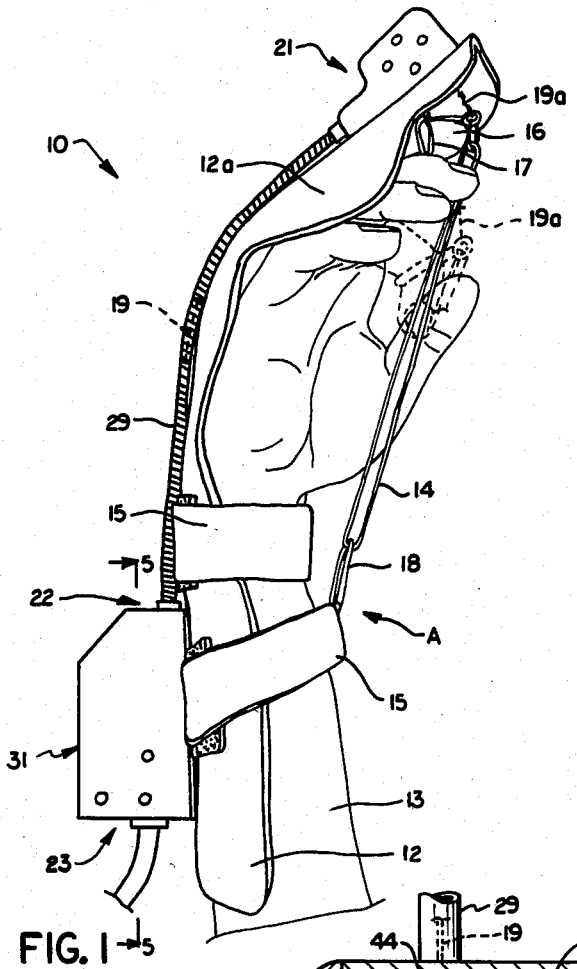
FIG. 1 is a side elevation of an apparatus embodying the concepts of the invention as the apparatus would typically be mounted on a human arm with the fingers shown in a somewhat extended position.

An apparatus according to the concepts of the present invention is generally indicated by the numeral 10 in FIGS. 1-6. Such an apparatus includes a drive unit 11 carried by a splint 12 mounted with straps 15 on the upper side of an extremity such as a human forearm 13 near the wrist. An elastic or elastomeric element 14, such as an ordinary rubber band or a spring, is placed under tension between the distal end of a digit or finger 16 and a rearward portion of the splint 12. This tension biases the fingers to a flexed position. As will be more fully described hereinbelow, the drive unit 11 provides means for opposing the bias of the rubber band to cause extension of the fingers in a controllable manner.

While the preferred embodiment of the invention will be described with particularity to a device for moving one finger, such description should not be interpreted in a limited sense. The invention can be used to induce movement of more than one finger on the same hand, including the thumb, by modifications which will be explained hereinafter.

Figure 2:
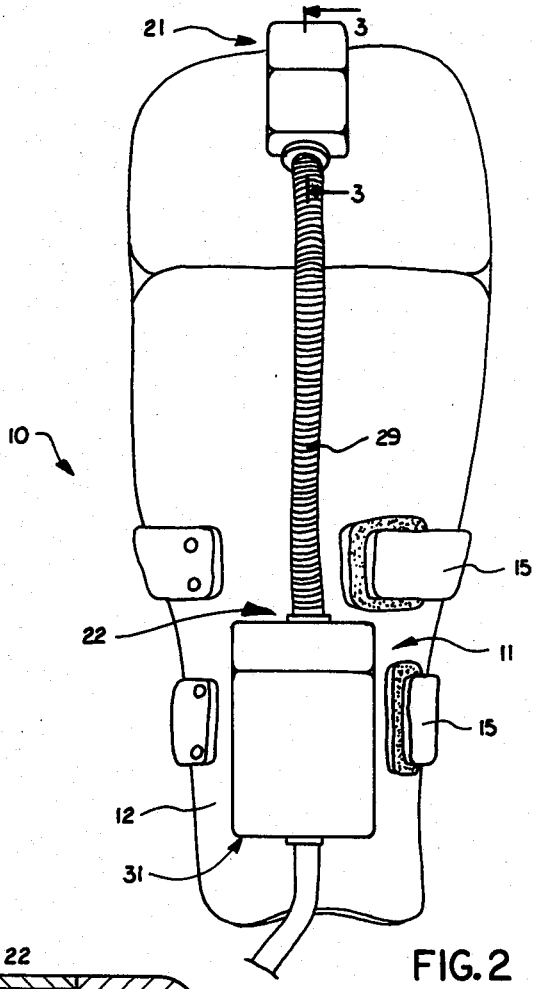
FIG. 2 is a plan view of the device shown in FIG. 1.

Referring to FIGS. 1 and 2, the splint shell 12 is formed from any suitable blank readily available from medical supplies. Typically, the splint blanks are flat plates which, when dipped in a suitable water solution according to the supplier's instructions, may be shaped and molded by the medical personnel to the desired configuration. As shown in FIG. 1, the splint 12 typically will curve along a forward portion 12*a*, thereby physically limiting the maximum finger extension. The actual shape of the splint 12 will vary on a case-by-case basis according to the medical personnel's determination of how much extension can be permitted without re-injuring the repaired areas. The present invention provides means for flexing and extending the fingers regardless of the actual splint configuration, it being realized that the splint portion 12*a* acts as a stop and defines the upper limit of the possible extension of the fingers. This feature is an important consideration when designing passive motion units because the hand must not be allowed to extend excessively; otherwise, the repair area may be re-injured, such as by tearing sutures.

The elastomeric element 14, preferably a rubber band, is attached at one end near a distal end of an associated finger 16, as by a plastic sleeve 17 placed over the fingertip. The opposite end of the rubber band 14 is secured to the lower side of the forearm, as at "A", by use of a band 18 attached to one of the splint straps 15. The rubber band 14 is mounted between the fingertip and splint so as to be under tension, thereby biasing or urging the finger to a flexed position, as shown in phantom in FIG. 1. By attaching the rubber band to the fingertip and by varying the location of the anchor point "A", the bias applied to the finger will move or flex the finger at all three articulated finger joints and with a radial motion. The degree of flexing motion, of course, can also be varied by adjusting the tension on the rubber band 14. When more than one finger is to be moved, a separate rubber band is used for each finger because each finger may have different requirements as to permitted degree of flexion and radial movement.

The drive unit 11 operates on an extensor cable 19 and includes a pulley mechanism 21, a feed unit 22 and a motor unit 23. The cable 19 is attached at one end to the fingertip via the sleeve 17 and generally opposite the rubber band 14. The cable 19 is relatively flexible, preferably made of multiple strands of stainless steel wire, so as to permit the finger to properly flex as the cable is paid out of the feed unit 22.

The cable 19 is carried by the pulley mechanism 21 to prevent frictional interference between the cable 19 and the splint 12. The pulley mechanism 21 is mounted on the splint as near as possible to the distal end of the fingertips, as shown in FIG. 1. In addition to minimizing frictional interference between the cable 19 and the forward edge of the splint 12, the pulley mechanism assures a generally vertical movement of the cable near the fingertip so that proper extension of the finger will occur when the cable is retracted into the feed unit 22.

Figure 3:
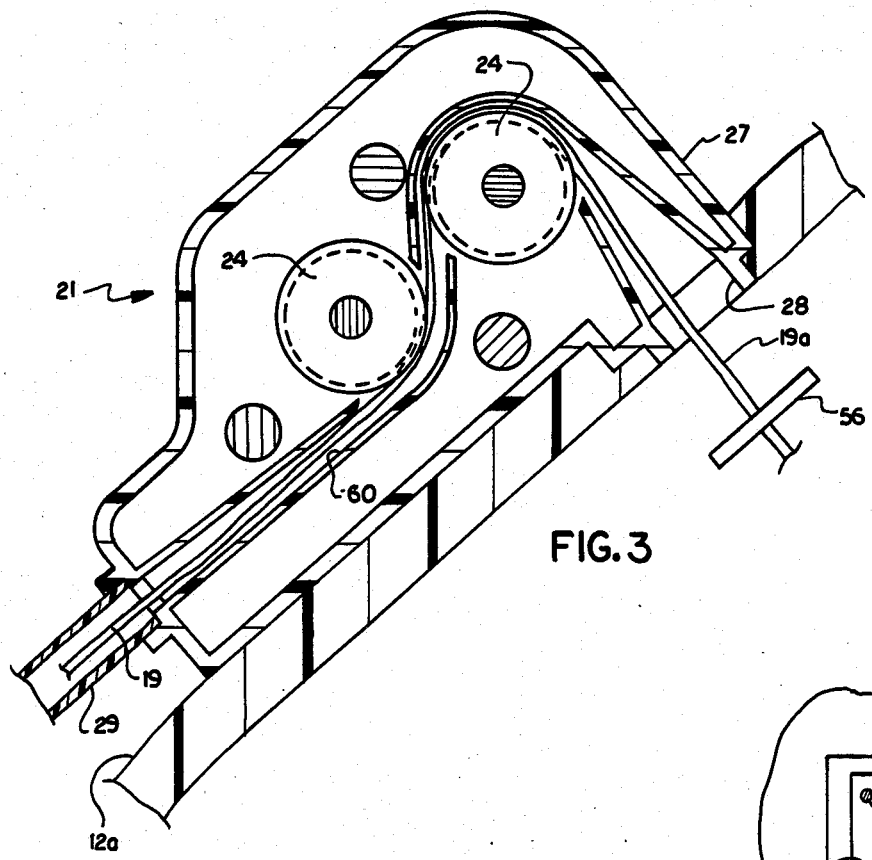
FIG. 3 is a laterally sectioned view of a pulley mechanism shown in FIG. 1 taken substantially along line 3—3.
Figure 4:
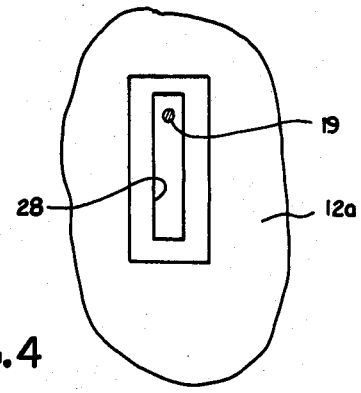
FIG. 4 is a bottom view of the pulley mechanism shown in FIG. 1.

Referring to FIG. 3, the pulley mechanism 21 can be designed by use of conventional rotary pulley wheels 24 supported in an enclosure 27. The enclosure is designed with a tight fitting channel to keep the cable in position in the enclosure 27. As shown in FIG. 4, the cable 19 exits the pulley mechanism 21 via a generally rectangular, slotted opening 28 in a bottom wall of the enclosure 27 and the splint 12. The slotted opening 28 permits transverse movement of the longitudinal cable portion 19*a* without interference from the walls of the enclosure 27. Such transverse movement will occur because, as the finger is flexed, the fingertip is pulled inwardly towards the palm of the hand by the rubber band 14. This finger motion results in a lateral pull on the cable portion 19*a* between the pulley mechanism 21 and the fingertip, as shown in phantom in FIG. 1. Of course, when the finger is extended, the cable portion 19*a* returns to a more vertical orientation.

A plastic guide tube 29 is attached to the pulley mechanism 21 by any convenient means, and provides a protective conduit for carrying the cable 19 along the upper forearm between the feed unit 22 and the pulley mechanism 21.

Figure 5:
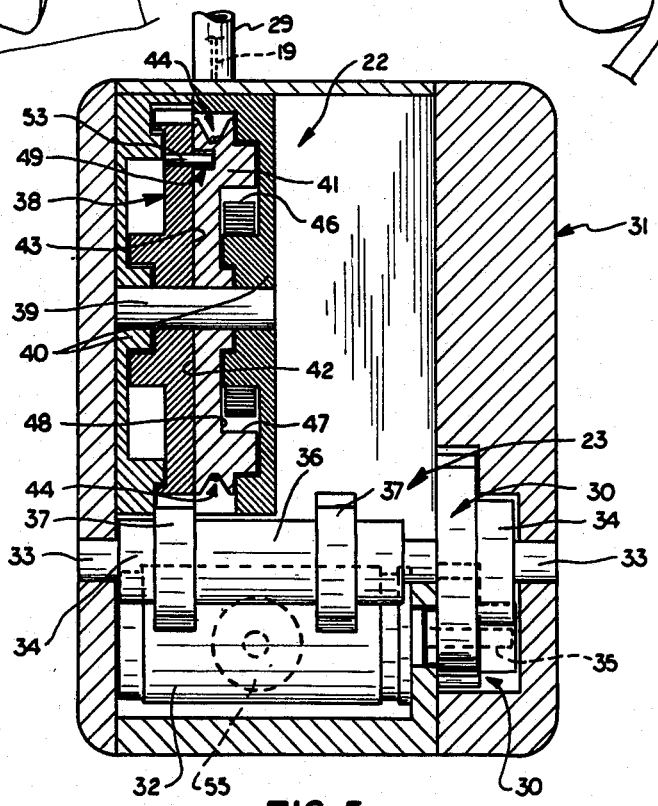
FIG. 5 is a sectioned view of a feed and drive unit taken substantially along line 5—5 of FIG. 1.

The feed unit 22 and the motor unit 23 are enclosed in a common housing 31, preferably made of a suitable plastic material. Referring to FIG. 5, the motor unit 23 includes the drive motor 32 used to activate the cable 19 feed or retraction. The drive motor 32 is preferably a conventional 12-volt D.C. bidirectional motor. The motor shaft 35 is coupled to a main drive shaft 33 via appropriate gear reduction 30 in a known manner. The main drive shaft 33 is carried in the housing 31 on journalled bearings 34, also in a known manner. The main shaft 33 drives a worm gear 36 and drives one or more main drive gears 37.

The motor unit 23 also includes associated electronic circuitry (not shown) for controlling the on-off operation of the motor, as will be more fully described hereinafter.

The feed unit 22 includes a drive wheel or disc 38 rotatably mounted on an axle 39 and coupled to the associated main drive gear 37. Thus, as the drive motor 32 is operated, the drive wheel 38 will rotate on the axle 39 at a speed determined by the selected gear reduction ratios and motor speed.

Rotatably mounted on the axle 39 and coaxial with the drive wheel 38 is a feed drum 41. The feed drum 41 provides a slotted face 42 which abuts an inner face 43 of the drive wheel. The feed drum 41 also provides a circumferential cable recess 44 about its outer side perimeter thereof. The cable 19 is wound onto the feed drum 41 within the recess 44. The end of the cable 19 within the feed unit 22 is fixedly attached to the feed drum by any suitable means. As the feed drum 41 rotates, the cable 19 is fed out of the feed unit 22 near the bottom thereof and through the guide tube 29. The cable 19 is retracted back into the feed unit 22 and wound onto the feed drum by simply reversing the direction of rotation of the feed drum 41 i.e., reversing the drive motor 32.

To ensure a relatively constant tension on the cable 19, the feed drum 41 is provided with a recoil spring 46 located in a recess 47 on an outer face 48 of the drum 41. The spring 46 is attached at one end to a rigid support 40 in the housing 31 and at the opposite end to the drum 41. The spring 46 is coiled in a manner similar to a tape measure spring so that as the cable 19 is fed out of the unit 22, the recoil spring is compressed and will counter-rotate the feed drum 41 and tend to rewind and pull the cable 19 back into the feed unit 22. The recoil force, however, is offset by the biasing force of the rubber band 14, which is axially applied to the cable 19 at the fingertip connection on the sleeve 17, as previously described. The recoil force of the spring must be less than the rubber band tension so that the cable 19 is generally urged out of the feed unit 22 so as to cause flexing of the finger. Thus, in order for the motor 32 to rewind the cable onto the feed drum 41, the motor need only develop enough torque to turn the feed drum so as to overcome the relatively small tension on the cable 19 from the rubber band.

The support 40 acts as a modular housing for the drive wheel and drum assembly. The module 40 can be easily inserted and removed from the main housing 31, thus permitting simplified repair of the apparatus 10, as well as allowing an efficient means by which the feed drum diameter can be changed.

Figure 6:
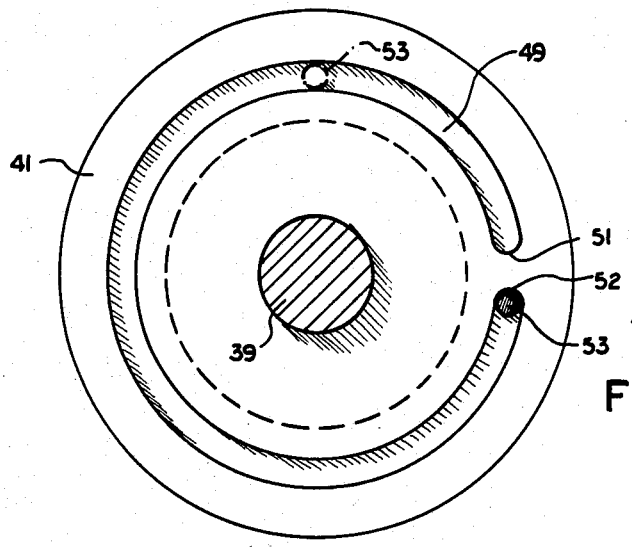
FIG. 6 is a plan view of a feed drum used in the device shown in FIG. 5.

The motor 32 drives the feed drum 41 in the following manner. The inner face 42 of the feed drum 41 is provided with a concentric recessed slot 49 as shown in FIG. 6. The slot 49 is formed only through about 340° of arc. Thus, two detent edges 51 and 52 are defined by the ends of the slot 49. The diameter of the slot 49 is generally uniform along the entire arcuate length thereof and is appropriately sized to receive a distal end of a dowel pin 53 rigidly mounted at the inner face 43 of the drive wheel 38.

Referring to FIG. 6, the feed drum 41 is biased by the recoil spring 46 in a counter-clockwise direction as viewed in FIG. 6. The rubber band 14 applies a tensile force to the cable 19, which tends to cause the feed drum 41 to turn clockwise, i.e., to feed out the cable 19 from the feed unit 22. Thus, the force of the rubber band offsets the recoil force and, being greater than the recoil force, the detent edge 52 engages the dowel pin 53. When the motor 32 is not actuated, the dowel pin 53, which is rigidly affixed to the drive wheel 38, acts as a stop and prevents the feed drum from unwinding and feeding out the cable, because the drive wheel 38 will be locked against rotation by the inoperative motor 32 and associated gears.

When the motor 32 is activated so as to feed cable (i.e., flex the finger), the motor drives the main shaft 33, which in turn drives the wheel 38 via the main drive gear 37. As the drive wheel 38 rotates, the dowel pin 53 tends to pull away from the detent edge 52, thus permitting the feed drum 41 to rotate. The bias of the rubber band 14 causes the feed drum 41 to rotate and thus feed out the cable 19. The speed at which the feed drum 41 rotates will be governed by the rotational speed of the drive wheel 38 since the dowel pin 53 will engage the detent edge 52 to prevent a more rapid cable feed rate.

In order to recoil the cable 19 (i.e., extend the finger), the motor unit 23 is actuated to reverse the direction of rotation of the motor 32, and hence the direction of rotation of the drive wheel 38. The dowel pin 53 engages the detent edge 52 and now acts to drive the feed drum 41 in the same direction of rotation as the drive wheel 38. The motor 32 need only develop enough torque to overcome the tensile force applied to the cable 19 by the rubber band 14.

Thus, in the preferred embodiment, the cable 19 is fed out of the unit 22 by the motor 32 releasing the feed drum for rotation and the cable is pulled out by the bias of the rubber band 14. In the take-up/recoil mode the motor 32 actively turns the feed drum via the dowel pin coupling.

Referring to FIG. 1, it can be seen that as the cable 19 is fed out of the unit 22, the increased length of cable between the feed unit 22 and the fingertip (i.e., the distal end of the cable 19) permits the rubber band 14 to flex the finger as shown in phantom. When this effective cable length is shortened, the finger is extended.

A feature of this design is that a sudden involuntary flexing of the finger by the patient, for example, when the patient is suddenly startled or during sleep, will be prevented. A sudden flexing of the finger will apply an increased tensile force to the cable 19. This increased force would tend to make the feed drum rotate faster than the drive wheel but the detent edge 52 will engage the dowel pin 53 and the feed drum 41 will be restrained from increasing the feed rate. If the motor 32 is inactivated, the feed drum is frozen from turning in a cable feed direction by the dowel pin and stationary drive wheel. Thus, the cable 19 feed rate, even with a sudden involuntary flexing, will be only a function of the speed permitted by the motor and drive wheel as determined by the gear reduction ratios.

An additional advantage of the invention is that the patient is able to suddenly and actively extend the finger without damaging the apparatus. The recoil spring 46, acting on the feed drum 41, provides a means for automatic take-up of slack in the cable 19 should the finger be further extended actively either while the motor is stopped or when the motor is feeding out the cable (i.e., flexing the finger) or when the motor is extending the fingers more slowly than the patient desires. In such situations, when the finger is actively extended by the patient, the patient overcomes the biasing force of the rubber band 14 and thus releases the tension on the cable 19 caused by the rubber band. But the feed drum 41 is still biased by the recoil spring 46, which will rotate the feed drum to rapidly take up any slack in the cable 19. This is particularly important if the motor is operating so as to feed out the cable (i.e., flex the finger) but the patient voluntarily extends the finger. In such a case, the drive wheel 38 is rotating but the feed drum 41 will not rotate at the same rate because the patient is resisting the tendency of the rubber band to flex the fingers. When this occurs, the dowel pin 53 slides along the slot (as shown in phantom in FIG. 6) and will continue to travel until it hits the detent edge 51. The drive wheel 38 is only permitted about a 340° turn until it is further prevented from turning by the non-rotating feed drum 41.

The drum 41 diameter and the size of the recess 44 are selected to accommodate the maximum amount of cable travel as the finger is fully exercised for the 340° rotation of the drive wheel 38. Thus, the patient can forcibly extend the finger a maximum permitted stroke without causing the tension on the cable 19 to go slack and jump off the pulley mechanism 21. Furthermore, whenever the medical personnel determine that a greater degree of flexion or extension is permissible, the diameter of the drum 41 can be changed to accommodate the new cable travel length within the 340° single stroke limitation so as to fully maintain the overtravel feature.

This overtravel feature maintains a relatively constant cable tension and prevents an excessive cable feed should the patient voluntarily resist flexion of the fingers or should an obstruction prevent the finger from flexing while the drive unit 11 is attempting to feed out the cable 19. Without the overtravel feature the cable 19 could bunch up or become tangled by being fed out at too fast a rate, and thus could also slip off the pulley wheels 24.

Another particular advantage of the present invention over other devices known heretofore is that the overtravel feature permits the patient to exercise the hand by voluntarily resisting the flexive force of the rubber band without damaging the drive unit. Also, the rubber band is more forgiving when the patient resists the force of the band. With prior units wherein a motor actively flexes the finger, the patient must resist the motor force applied to a rigid cable in order to extend the finger as an exercise. This resistance can damage the motor or the hand since the tension control on the cable by the motor is not as constant and controllable as by a rubber band. Thus, the present invention, by utilizing an active extension/passive flexion design permitted by the hand being located intermediate the motor and biasing element, has many therapeutic and medical advantages over the prior art.

The motor unit 23 contains a control circuit 54 (not shown) having the logic circuits, switches and power circuits for operation of the drive unit 11. Implementation of the control circuit 54 is accomplished in a known manner with conventional discrete components and is well with the expertise of any person skilled in the art. A standard microprocessor may also be used in place of discrete components for carrying out the functions of the controller as specified herein.

Referring to FIG. 5, a multiturn potentiometer 55 is mechanically coupled to the worm gear 36 and feeds back to the control circuit 54 a voltage proportional to the length of cable paid out of the feed unit 22 because each turn of the worm gear 36 corresponds to a known amount of cable length and also turns the potentiometer through a known change in resistance. The length of the cable fed out or retracted is directly related to the degree of flexion or extension of the finger. This potentiometer setting is compared to preset limits by the control circuit 54 to determine the on-off cycle of the motor.

A zero reference point for the control circuit 54 is selected, and preferably is the physical limit of extension of the finger which, as previously described, will be determined by the medical personnel and limited by the configuration of the formed splint 12. The medical personnel then determine the maximum degrees of flexion and extension within which the repaired hand can safely operate. These limits are inputted to the control circuit 54 in a known manner and the position of the finger as represented by the potentiometer 55 setting is compared to the flexion and extension limits to regulate the amount of cable 19 that is fed out and/or retracted by the feed unit 22.

To protect the patient from a possible electronic failure, a backup mechanical stop is provided to limit the possible extension of the finger. This stop is provided by a sleeve or tab 56 (FIG. 3) which is oversized with respect to the slot 28. The sleeve 56 is attached to the cable 19 at an appropriate location to prevent further retraction of the cable into the feed mechanism 22, hence limiting the possible extension of the finger. Of course, the sleeve 56 only limits the passive extension of the finger caused by the device 10. Because the cable 19 is flexible, active extension is only limited by the splint 12.

The control circuit 54 is designed to operate in a manual or automatic mode, selection of the operating mode being controlled by the patient via a throw switch (not shown). In manual mode the patient pushes either a flex or extend actuation switch and power is thus supplied to the motor 32 to cause the feed drum 41 to either feed out or retract, respectively, the cable 19. The control circuit monitors, via the potentiometer reading, the degree of flexion and extension and inhibits the drive motor whenever the preset limits are reached.

In an automatic mode the control circuit 54 continuously operates the motor to move the finger between the preset flexion and extension limits; the control circuit 54 automatically reverses the drive motor 32 when a limit is reached. Thus, in the automatic mode, the finger can be safely and continuously exercised. Again, the overtravel feature described hereinabove is particularly useful with the automatic mode as constant cable tension is maintained should an obstruction to the finger prevent proper flexion. The control circuit is also designed to permit different operating speeds by varying the supply current to the drive motor.

A typical sequence of operation will now be described but such is provided by way of example only and should not be interpreted as limiting in any sense.

Preferably, the invention described hereinabove is used as soon as possible after reconstruction surgery, joint replacement, or similar medical procedures in order to minimize the risk of re-injury as well as to augment the rehabilitative and therapeutic stages of recovery. The medical personnel, typically the surgeon, shapes the splint 12 and attaches it to the patient's forearm. The splint acts as a physical stop to extension of the finger as shown in FIG. 1. Next the drive unit 11 is mounted on the splint, and the rubber band 14 and cable 19 are respectively attached to the distal end of the finger. The surgeon determines within his acquired skill and knowledge the maximum degrees of flexion and extension within which the finger can safely move without re-injuring the repair area. These limits are then inputted to the motor unit 23 by a set of thumbwheel switches (not shown).

In a manual mode of operation, when the patient desires to flex the finger, the flex switch is actuated and the motor 32 turns the drive shaft 33 in the proper direction so as to cause the feed drum to turn, thereby releasing the cable 19 out of the feed unit 22. The rubber band 14 is under tension and pulls the finger down (i.e., passive flexion) at a speed determined by the cable 19 feed-out rate set by the drive motor 32.

Via the potentiometer 55, the control circuit 54 monitors the degree of flexion and if the present limit is reached the motor is shut off automatically. While the cable 19 is being released from the feed unit 22, the patient may desire to resist the flexive force of the rubber band by extending the finger. The overtravel design of the drive wheel 38 and feed drum 41 prevents an excessive feed of the cable as described hereinabove.

The drive unit can also be used to extend the finger by simply reversing the direction of rotation of the motor 32, and hence the drive wheel and feed drum. Thus, finger flexion is achieved by increasing the length of the cable 19 between the feed drum 41 and the distal end of the cable 19 attached to the fingertip, and finger extension is achieved by shortening the length of the cable 19 between the feed unit and the associated fingertip. Sudden or involuntary flexing of the fingers in excess of the rate permitted by the controlled motor speed is prevented by the drive wheel dowel pin 53 inhibiting excessive rotation of the feed drum 41 as described hereinabove.

While the preferred embodiment has been described with reference to passive movement of one finger, such description is for exemplary purposes only. The present invention is modifiable to accommodate all five fingers, including the thumb, on a human hand. A separate rubber band/cable combination is used for each finger and an individual pulley support is provided for each cable passing through the pulley mechanism 21. A separate cable feed mechanism 22, comprising the drive wheel 38 and feed drum 41 and associated parts, is used for feeding each cable and thus a separate drive gear 37 is used for each drive wheel 38. However, since all the fingers are to be driven simultaneously, all the drive gears 37 can be driven from a common drive shaft 33 and motor 32. The feed unit 22 illustrated in FIG. 5 is set up to accommodate two cable feed mechanisms which are self-contained units which are simply inserted into the chamber of the feed unit 22. Of course, each finger will have its own length of cable needed to cause the desired flexion because typically the fingers are all different lengths and flex at different angles. The cable length variations are accommodated by varying the diameter of the feed drums 41. Of course, the invention can be used to exercise other digits such as toes, in which case the device 10 would be mounted on a lower extremity such as a foot.

The cable feed mechanism 22 is easily removed so that if some portion of this mechanism fails, it is easily replaced. Also, this feature allows the same drive motor to be used with cable feed mechanisms having different size feed and drive drums, so that the motor may be operating at one speed while individual fingers are flexed and extended differing amounts.

Except for the motor 32, the various mechanical parts of the drive unit 11 described herein can be made of durable plastics. The drive unit 11 thus is a very lightweight device and does not present a cumbersome unit attached to the arm. The control circuit 23 requires minimal space even with the use of discrete electrical components and can be fully mounted within the housing 31. Electrical power is supplied to the drive unit from a conventional wall plug through a suitable transformer-rectifier. Because of the low power requirements of the motor 32, however, it is contemplated that a self-contained power supply can be included in the housing 31.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A device for passively exercising a digit of a human limb comprising:

an elastic element biasing the digit towards a first position and drive means for selectively moving the digit between the first position and a second position by applying a force to the digit substantially opposing the bias of the elastic element;

the drive means comprising a cable operatively connected to the digit to a drum driven by a reversible motor; and overtravel means for maintaining a relatively constant tension on the cable independently of the rate of the motor, the overtravel means comprising a drive wheel rotatable with respect to the drum and operably coupled to the motor and the drum, the drive wheel permitting the drum to rotate in a first direction as the elastic element applies a tension to the cable when the motor rotates the drive wheel in said first direction and the drum is inhibited from rotating in the first direction other than when the motor rotates the drive wheel in the first direction, and the drive wheel rotating the drum in a second opposite direction when the motor rotates the drive wheel in a second opposite direction;

and said overtravel means further comprising a means for biasing said drum in said second opposite direction against the bias of the elastic element so as to maintain a constant tension on the cable should a sudden movement of the digit occur in said first or second direction.

2. A device according to claim 1, wherein said drum is biased to rotate in said opposite direction, said motor rotating said drive wheel and drum by overcoming tension on said cable by said elastic element, said elastic element bias being greater than said drum bias.

3. A device according to claim 1, wherein said drive wheel is coaxial with and operably coupled to said drum by a pin mounted on said wheel and slidably engaging a circumferential slot in a facing side of said drum, said slot providing two detent edges, one of said detent edges engaging said pin as said drum rotates with said drive wheel, said pin and said one detent preventing said drum from rotating in said first direction faster than said drive wheel, said pin sliding along said slot towards another of said detent edges when said drum rotates in said opposite direction with respect to said drive wheel thereby maintaining a relatively constant tension on said cable and preventing excess cable slack.

4. A device according to claim 3, wherein said first direction corresponds to a flexion of the digit and said opposite direction corresponds to an extension of the digit.

5. A device according to claim 3, wherein said elastic element is an elastomeric member under tension and operatively joined at one end to a distal end of the digit and operatively joined at an opposite end to the limb, said elastomeric element pulling on said digit distal end so as to induce movement of the digit in each associated joint and with some radial motion.

6. A device according to claim 3, wherein said drum and drive wheel are located in a module adapted to be removably inserted into a housing means for enclosing said motor.

7. A device according to claim 6, wherein said drum is biased by a coiled spring acting on said drum and module.

8. A device according to claim 3, wherein the drum defines a diameter, and movement between said first and second positions defines a maximum cable length, said drum diameter permitting said maximum length to be wound and unwound from said drum in less than one rotation of said drum.

9. A portable cable feed mechanism for use with a continuous passive motion device to cause continuous passive motion of a digit on a human limb comprising:

a flexible cable attached at a first end to the digit;

a housing including a rotatable drum mounted within said housing, the cable being operatively connected to the drum at a second end such that rotation of the drum in a first direction unwinds the cable to extend cable, and rotation of the drum in a second direction winds the cable about the drum to retract cable, said drum having means for biasing the drum to rotate in the second direction;

a drive wheel operably associated with drive wheel motor means and mounted in said housing in coaxial relationship with the drum to form two rotational members, the drive wheel being operatively connected to the drum to drive the drum and having overtravel means which allows independent operation of the drum and the drive wheel motor means;

said overtravel means operably associated with the drum for maintaining a relatively constant tension on said cable independently of the rate of travel of the drive wheel, the overtravel means comprising a slot on one of the two rotational members, the slot providing two detent edges, the other rotational member including a pin which engages the slot and further engaging one of the detent edges when the rotational members rotate coincidentally, and the pin sliding along the slot as a result of said drum biasing means when one rotational member rotates at a rate of rotation which varies from the rate of the other rotational member so that the cable is subjected to at least a minimum tension.

10. A cable feed mechanism according to claim 9, wherein said slot has an arcuate length less than 360° and said drum feeds a predetermined maximum amount of cable within an angular rotation corresponding to said slot arcuate length.

11. A cable feed mechanism according to claim 9, wherein the motor means, drive wheel, and drum are carried by a common support, said drive wheel and drum being mounted in a module adapted to be removably attached to said support.

* * * * *

UNITED STATES PATENT AND TRADEMARK OFFICE

CERTIFICATE OF CORRECTION

PATENT NO. : 4,644,938

DATED : February 24, 1987

INVENTOR(S) : Jan B. Yates et al.

It is certified that error appears in the above-identified patent and that said Letters Patent is hereby corrected as shown below:

On the title page, Item [73] should read:

-- [73] Assignee: Danninger Medical Technology, Inc. --.

Signed and Sealed this

Eighth Day of December, 1987

*Attest:*

DONALD J. QUIGG

*Attesting Officer*

*Commissioner of Patents and Trademarks*